US006058507A

United States Patent [19]

Klimenko

[11] Patent Number: 6,058,507

[45] Date of Patent: May 9, 2000

[54] INFLATABLE FABRICS AND CLOTHING

[75] Inventor: Konstantin Klimenko, Los Angeles, Calif.

[73] Assignee: Sevylor U.S.A., Inc., Los Angeles, Calif.

[21] Appl. No.: 09/226,928

[22] Filed: Jan. 8, 1999

Related U.S. Application Data

[60] Provisional application No. 60/074,506, Feb. 12, 1998.

[51] Int. Cl.[7] ..... A41D 7/00

[52] U.S. Cl. ..... 2/67; 2/69; 450/38; 441/121

[58] Field of Search ..... 2/67, 69, DIG. 3; 450/38, 39; 441/102, 103, 106–108, 114–121

[56] References Cited

U.S. PATENT DOCUMENTS

| | | | |
|---|---|---|---|
| 1,478,239 | 12/1923 | Marengo et al. | 441/117 |
| 1,709,873 | 4/1929 | Petersen | 441/117 |
| 2,389,735 | 11/1945 | Morner | 441/117 |
| 2,521,205 | 9/1950 | David | 441/120 |
| 3,098,248 | 7/1963 | Geier | 2/67 |
| 5,303,425 | 4/1994 | Mele . | |
| 5,347,656 | 9/1994 | Fabritz et al. | 2/67 |
| 5,502,842 | 4/1996 | Wagner | 2/67 |

*Primary Examiner*—Gloria M. Hale

*Attorney, Agent, or Firm*—Dean W. Russell; Kilpatrick Stockton LLP

[57] ABSTRACT

Inflatable articles of clothing are disclosed. Using in many cases multiple plies of material impervious to air, inflatable pockets are created. Valves may also be included to facilitate introducing air into the pockets and, if necessary, to permit their deflation.

10 Claims, 2 Drawing Sheets

INFLATABLE FABRICS AND CLOTHING

REFERENCE TO PROVISIONAL APPLICATION

This application is based on and hereby refers to U.S. Provisional Patent Application Serial No. 60/074,506, filed Feb. 12, 1998, having the same title as appears above.

FIELD OF THE INVENTION

This invention relates to articles of clothing and more particularly to inflatable fabrics and clothing such as (but not necessarily limited to) one- and two-piece swimsuits.

BACKGROUND OF THE INVENTION

Articles of clothing have been made throughout history for numerous purposes and using myriad fabrics. Wool and cotton constitute traditional materials from which clothing is manufactured; by contrast, newer synthetic materials include polyesters and polyester blends. Whether natural or synthetic, these materials are not typically designed for inflation, but rather are sufficiently porous often to permit some passage of air.

U.S. Pat. No. 5,303,425 to Mele discloses a shirt designed to provide convection cooling of the skin of a wearer. Glued to the inside of the shirt is an inflatable tubular structure. When the tubular structure is inflated, it opens flaps that allow air to enter through slits in the shirt and contact the wearer's skin. The tubular structure additionally includes a valve at its upper end purportedly to "maintain the level of air pressure" therein.

Although touted as "inflatable clothing apparatus," the shirt of the Mele patent is not itself inflatable. Air or other fluid is not, for example, retained within the fabric of the shirt; instead, only the tubular structure glued to the interior of the shirt is inflated. Moreover, the shirt intentionally is cut to permit ambient air to flow through it. Even were the shirt otherwise characterized as impervious to air (which it is not in the Mele patent), the slits render it incapable of trapping the air within its fabric.

SUMMARY OF THE INVENTION

The present invention, by contrast, provides articles of clothing that themselves are inflatable. Typically utilizing multiple plies of fabric impervious to air or other appropriate fluid, inflatable pockets are created to retain fluid introduced therein. Conventional or other valves may also be included to facilitate introducing fluid into the pockets and, if necessary, to permit their deflation.

Unlike the shirt of the Mele patent, the articles of the present invention are not intended to enhance airflow to the skin of a wearer. Rather, the article itself remains adjacent the wearer's skin (or adjacent other clothing of the wearer). In some cases this arrangement may increase the comfort of the wearer. Depending on the nature and quantity of the fluid introduced into the clothing, additional buoyancy may also result (although the clothing is not intended to be a life preserver). In either circumstance, however, the attractiveness and aesthetic appeal of the clothing cannot be denied.

One embodiment of the invention comprises an inflatable bikini. Using fabric made of polyvinyl chloride (PVC), two plies are formed for each of the top and bottom pieces of the bathing suit. Edges of the corresponding plies are then sealed to create pockets within each of the pieces, and a valve is installed in each piece to permit introduction of air into the pockets. Hook and loop (e.g. Velcro) or other suitable fasteners may be utilized to attach the bikini to the wearer. For increased stability (of, for example, the shape of the bikini), spot welds of the PVC plies in the region of the pockets may be included. Again, however, notwithstanding its inflatability the bikini is intended to constitute an article of clothing—in some respects a fashion item—rather than a life preserver, jacket, or vest.

It is therefore an object of the present invention to provide articles of inflatable clothing.

It is also an object of the present invention to provide articles of clothing made at least in part of one or more materials impervious to air.

It is another object of the present invention to provide wearable materials in which pockets are created and into which fluid may be introduced.

It is an additional object of the present invention to provide articles of clothing containing valves to facilitate inflation and deflation and fasteners to facilitate attachment to a wearer.

It is yet another object of the present invention to provide inflatable one- and two-piece bathing suits.

Other objects, features, and advantages of the present invention will be apparent with reference to the remainder of the text and the drawings of this application.

DETAILED DESCRIPTION

Figure 1A:
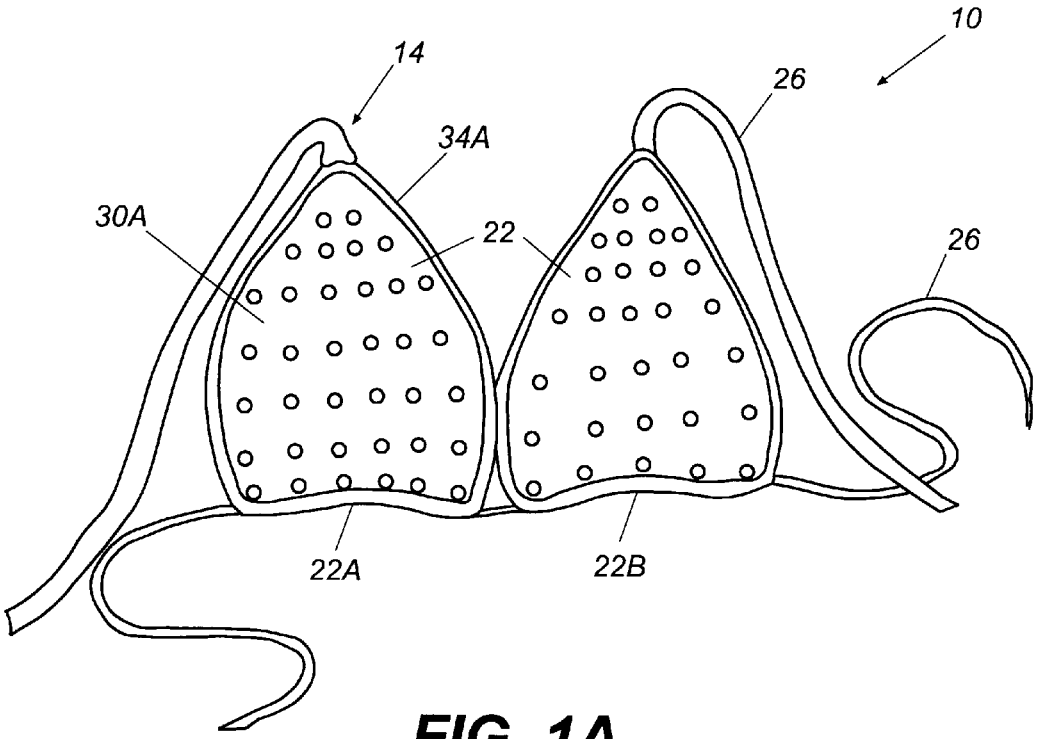
FIGS. 1A–B present, in plan view, faces of an exemplary two-piece article of the present invention.
Figure 1B:
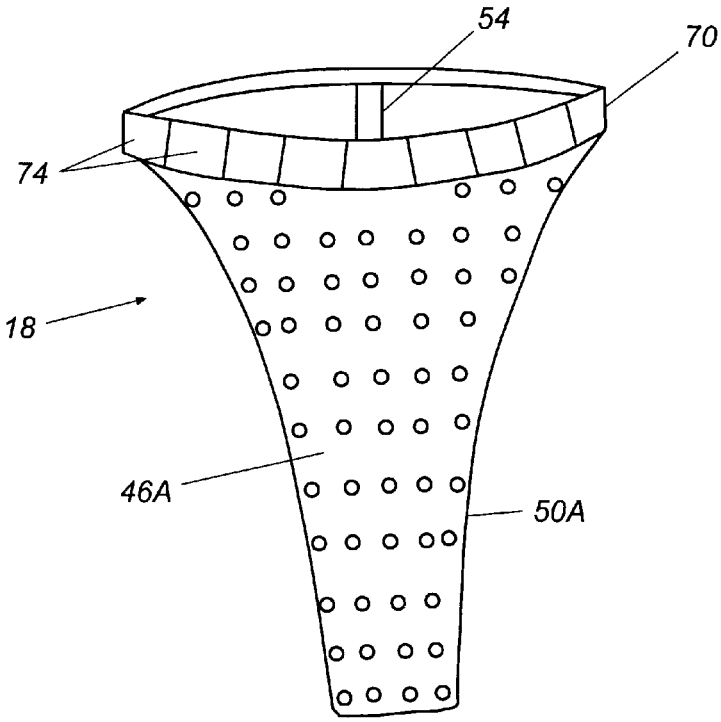

FIGS. 1A–B and 2A–B illustrate article 10, an example of the present invention. In this example article 10 is a two-piece (bikini) bathing suit and includes top 14 and bottom 18. Top 14 thus comprises cups 22 and straps 26 for attachment about the neck and torso of a female wearer. Straps 26 may be made of PVC or any other material capable of being connected permanently to cups 22.

Each of cups 22A and 22B includes two plies of material 30A and 30B formed to be impervious to air (or other appropriate inflation fluid). Although in presently-preferred embodiments of article 10 plies 30A and 30B are made of PVC, those skilled in the art will recognize that compositions other than PVC may be useable consistent with the present invention. Those so skilled will also recognize that in some cases two separate plies may not be necessary (as, for example, with materials whose internal structures permit entrapment of air). Nonetheless, for article 10, plies 30A and 30B are shaped substantially identically and their respective edges 34A and 34B are sealed (by heating, ultrasonic welding, or any other suitable technique).

Figure 2A:
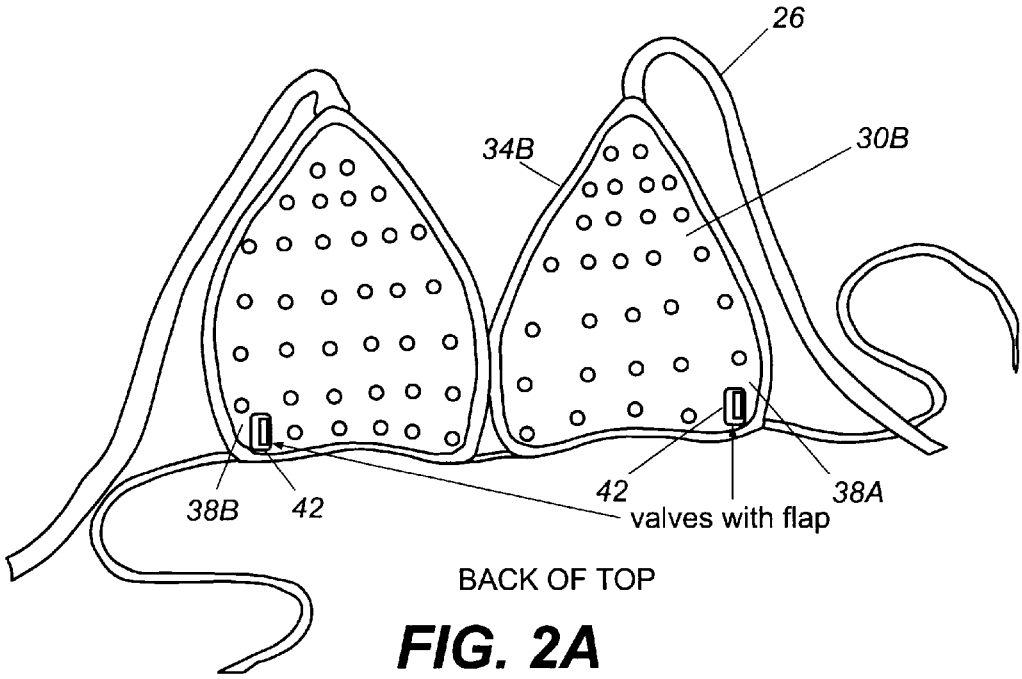
FIGS. 2A–B present, again in plan view, the reverses of the article of FIGS. 1A–B.
Figure 2B:
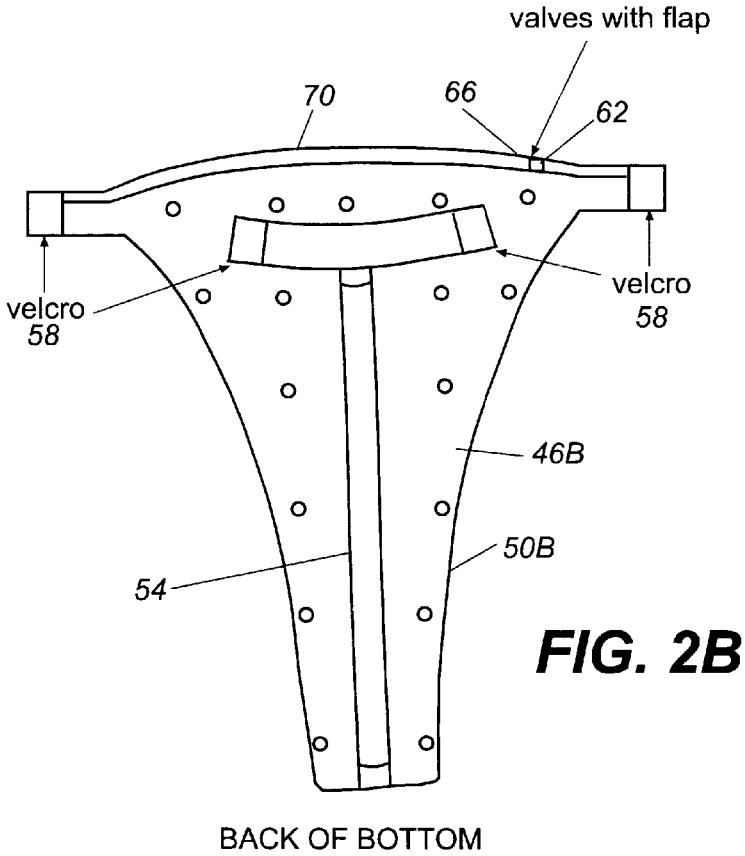

Sealing edges 34A and 34B effectively forms a pocket into which air may be introduced. FIG. 2A details valves 38A and 38B, one for each of cup 22A and 22B, through which air may be inserted into the cups 22. Because valves 38A and 38B are in the illustrated embodiments designed to be placed in plies 30B closest to the skin of the wearer, they may be covered by displaceable flaps 42 of suitable material. Greater stability in structure or shape of top 14 may sometimes be obtained by connecting (by, for example, spot welding or otherwise) portions of plies 30A and 30B in the area of the pocket. Doing so results in a lattice of connected and unconnected portions of plies 30A and 30B, with any injected air filling the space between the unconnected portions of the plies 30.

Bottom 18 is conceptually similar to top 14. Intended to cover the pubic region of a female wearer, bottom 18 shown in FIGS. 1B and 2B includes plies 46A and 46B whose respective edges 50A and 50B are sealed together. Bottom 18 additionally may incorporate thong 54 and hook and loop fasteners 58 to facilitate attachment to the wearer. Valve 62 may be used to inflate the pocket formed by plies 50A and 50B and may be covered (when desired) by flap 66.

Like plies 30A and 30B of top 14, plies 50A and 50B may be connected in some areas of the pocket they form. For stability in use, bottom 18 additionally may include a waistband 70 whose plies inflate as (horizontally-oriented) rectangles 74. Those skilled in the art will, however, recognize that other stabilizing methods may be employed consistent with the present invention. Thus, although the foregoing is provided for purposes of illustrating, explaining, and describing embodiments of the present invention, further modifications and adaptation to these embodiments will be apparent to those skilled in the art and may be made without departing from the scope of spirit of the invention.

I claim:

1. An inflatable article of clothing designed to be worn as at least a portion of a swimsuit, comprising:

a. first and second inflatable cups adapted to cover at least a portion of each of a pair of female breasts;

b. a first valve at least indirectly connected to the first cup for introducing air into the first cup so as to inflate it; and c. a second valve at least indirectly connected to the second cup for introducing air into the second cup so as to inflate it independently of the first cup.

2. An inflatable article of clothing according to claim 1, further comprising a flap for covering the first valve when not in use.

3. An inflatable article of clothing according to claim 1, further comprising a plurality of straps for attaching the article to the wearer, at least one of the straps being connected to at least one of the cups.

4. An article of clothing defining at least a portion of a swimsuit, comprising:

a. a first ply of plastic material having an edge;

b. a second ply of plastic material having an edge, at least a portion of its edge being sealed to at least a portion of the edge of the first ply so as to form an inflatable region;

c. a valve connected to at least one of the first and second plies, for permitting inflation of the inflatable region;

d. a band, connected to at least one of the first and second plies, for attaching the article of clothing at or adjacent the waist of a wearer; and e. spot seals of portions of the first and second plies other than their edges.

5. An article of clothing according to claim 4 in which at least a portion of the band is inflatable.

6. An inflatable bikini-style swimsuit, comprising:

a. a top comprising:

i. first and second inflatable cups, each cup adapted to cover at least a portion of a female breast;

ii. a first valve connected to at least one of the first and second cups for permitting inflation thereof; and iii. a plurality of straps for attaching the first and second cups to a female wearer; and b. a bottom comprising:

i. an inflatable cover adapted to fit about at least a portion of a female pubic region;

ii. a second valve connected to the cover for permitting inflation thereof; and iii. a band connected to the cover for attaching it to the female wearer.

7. An inflatable swimsuit according to claim 6 in which the first valve is connected to the first cup, further comprising a third valve connected to the second cup for permitting inflation thereof.

8. An inflatable article of clothing designed to be worn as at least a portion of a swimsuit, comprising:

a. at least two plies, each having an edge sealed to an edge of the other, defining material adapted to cover at least a portion of a female pubic region;

b. a valve connected to at least one of the plies for introducing air into the material so as to inflate it; and c. a band connected to at least one of the plies for attachment to the wearer.

9. An inflatable article of clothing according to claim 8 in which at least a portion of the band is inflatable.

10. An article of clothing defining at least a portion of a swimsuit, comprising:

a. a first ply of plastic material having an edge;

b. a second ply of plastic material having an edge, at least a portion of its edge being sealed to at least a portion of the edge of the first ply so as to form an inflatable region; and c. spot seals of portions of the first and second plies other than their edges.

* * * * *